United States Patent [19]

Showalter

[11] Patent Number: 5,025,862

[45] Date of Patent: Jun. 25, 1991

[54] STEAM INJECTION PIPING

[75] Inventor: William E. Showalter, Long Beach, Calif.

[73] Assignee: Union Oil Company of California, Los Angeles, Calif.

[21] Appl. No.: 443,931

[22] Filed: Nov. 30, 1989

[51] Int. Cl.[5] ..... E21B 36/00

[52] U.S. Cl. ..... 166/303; 166/57; 166/242; 166/302; 138/114; 138/146

[58] Field of Search ..... 166/57, 265, 302, 303, 166/311, 242, 902; 220/426, 445, 450, 454, 455; 138/111-114, 146; 137/334, 594

[56] References Cited

U.S. PATENT DOCUMENTS

| | | | |
|---|---|---|---|
| 3,142,336 | 7/1964 | Doscher | 166/272 |
| 3,380,530 | 4/1968 | McConnell et al. | 166/57 |
| 3,386,512 | 6/1968 | Bloom | 166/303 |
| 3,397,745 | 8/1968 | Owens et al. | 166/57 |
| 3,424,249 | 1/1969 | Hamby, Jr. et al. | 166/303 |
| 3,559,738 | 2/1971 | Spillette | 166/303 |
| 4,058,164 | 11/1977 | Stoddard et al. | 166/303 |
| 4,189,519 | 2/1980 | Berg | 219/10 |
| 4,263,970 | 4/1981 | Cha | 166/261 |
| 4,304,302 | 12/1981 | Carlin et al. | 166/303 |
| 4,549,935 | 10/1985 | Tchernyak | 196/14.52 |
| 4,589,488 | 5/1986 | Shirmer | 166/270 |

OTHER PUBLICATIONS

"Thermal Radiation Properties Survey", by G. G. Gubareff, J. E. Janssen, R. H. Torboug, 2nd Ed., Tables 128-163, pp. 91-114, Honeywell Research Center 1960.

"Proceedings of the Petroleum Conferences", Thermal Oil Recovery, Steam Soak Results—Sisquag Pool—CAT Canyon Oil Field—Santa Barbara Country by W. K. Dietrioh and G. D. Willate, Jun. 6, 1966.

"Thermocase Product Description and Thermocase Production Tubulars", by Kawasaki Thermal Systems, Tacoma, Wash.

*Primary Examiner*—Bruce M. Kisliuk

*Attorney, Agent, or Firm*—Gregory F. Wirzbicki; William O. Jacobson

[57] ABSTRACT

A steam injection pipe system within a cased wellbore is processed to reduce the emissivity of an outwardly facing surface. The pipe system is combined with: (1) a cleaning device or process for maintaining the low emissivity surface; and (2) a mixed fluid non-condensable gas supply to exclude steam from an annular space. This achieves a low cost and low thermal loss steam injection system. The pipe is composed of stainless steel and is polished to reduce the emissivity. The pipe is assembled and run into a cased wellbore. The polished surface of the pipe sections is solvent washed and surrounded by a non-condensable gas within the casing-/pipe annulus. The non-condensable gas is introduced at the periphery of the injection pipe, mixed with the steam, and separated down-hole to fill the annulus. The cleaned low emissivity surface and mixed feed fluid gas supply achieves a significant reduction in heat loss without costly pipe insulation when compared to bare pipe injection.

17 Claims, 1 Drawing Sheet

FIG. 1.
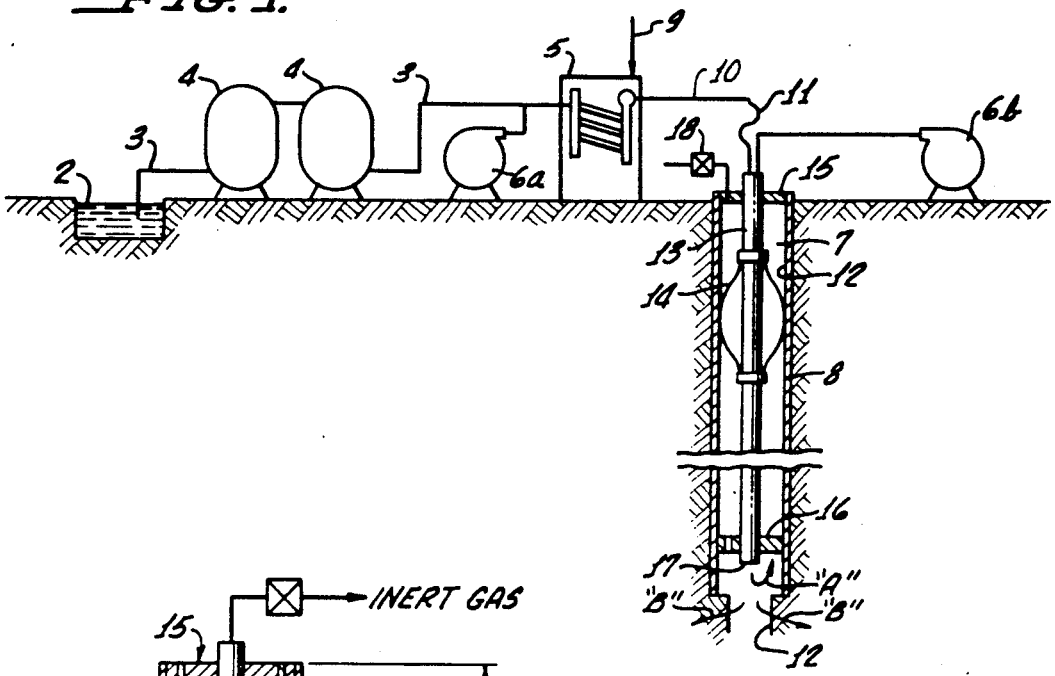
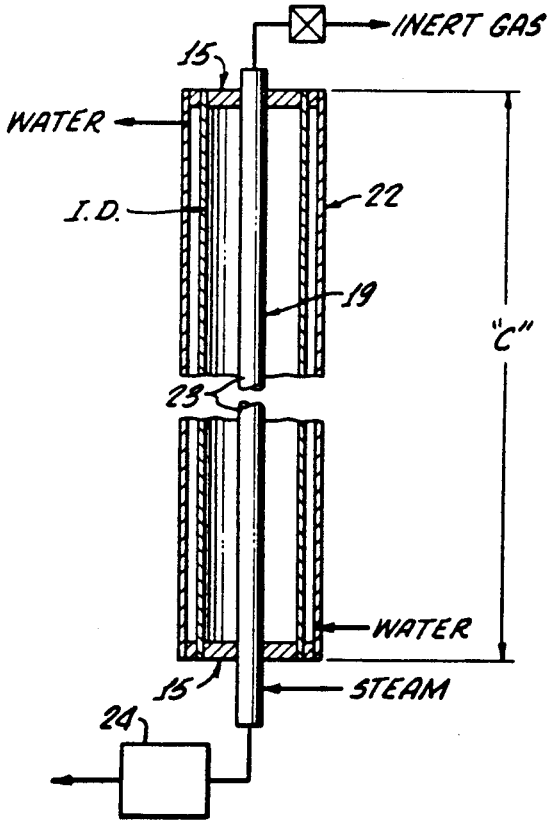
FIG. 3.
FIG. 2.
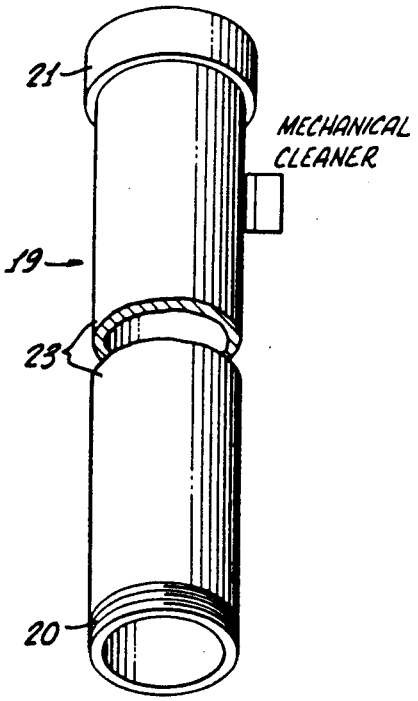

STEAM INJECTION PIPING

FIELD OF THE INVENTION

This invention relates to well drilling and completions. More specifically, the invention is concerned with providing steam injection piping for an oil well application which reduces thermal losses during thermal recovery operations.

BACKGROUND OF THE INVENTION

Some oil (and other natural resource) recovery processes involve the conduction of hot fluids to/from an underground formation. For example, thermal recovery of a viscous oil, especially from a low permeability formation, may require heating devices and processes for the oil to be economically recoverable. In some of these thermal recovery devices and processes, heating is accomplished by injecting steam (from surface steam generating facilities) into the formation through a wellbore. Steam injection may be cyclic (e.g., "huff and puff") or long term (e.g., "steam drive fields"). The steam generation facilities must be sized for wellbore heat transmission losses, as well as the injection of steam in the underground formation.

Even if the wellbore is cased and cemented, the wellbore heat losses can be substantial and therefore costly. Wellbore heat losses during steam injection may decline with time but remain significant in typical steam drive or cyclic applications. The wellbore may also be used for purposes other than steam injection (e.g., oil production), requiring minimal flow obstruction or removal of the wellbore steam injection system.

The primary objectives of a wellbore steam injection system are to: (1) be easy to install into the wellbore; (2) conduct steam from the surface to the underground zone; (3) minimize thermal losses; (4) minimize wellbore flow obstruction or be removable; and (5) be able to handle a variety of fluid and environmental conditions. The steam injection piping should also be rugged in construction, easy to maintain, reliable, and low in cost. The system should also be capable of protecting other components from excessive heating.

Most of the current steam injection piping systems may do some of these objectives well, but other objectives may be accomplished poorly or not at all. One approach is to complete the well with an insulated tubular (i.e., insulated casing) cemented in the wellbore. An example of an insulated casing is Thermocase 750 vacuum insulated (i.e., double wall) tubular sections supplied by Kawasaki Thermal Systems, Inc., Tacoma, Washington. The insulated casing can be used directly for oil production or steam injection.

The well may also be conventionally completed (e.g., uninsulated tubulars or casing cemented in the wellbore) and a separate steam injection pipe or tubing string installed within the cased wellbore. The injection pipe is also typically centered within the casing.

The steam injection pipe may be uninsulated (i.e., bare). Although a bare steam injection pipe somewhat reduces thermal losses when compared with direct injection into a conventionally cased wellbore, the losses remain high. The bare steam injection pipe has the advantages of low initial cost and minimal flow obstruction (when compared to insulated tubulars). It also allows a corrosion resistant material to be used if necessary to contain the steam or other formation heating fluid.

However, the increasing cost of energy (i.e., high thermal losses) exacts an operating cost penalty for the advantages of bare steam injection piping. Related bare injection pipe problems include possible overheating-/overstressing overstressing of the cemented casing, unacceptable steam quality (e.g., condensation of steam before reaching the formation face), and thermal shock (e.g., cold kill) failure of the cemented casing.

An insulated steam injection pipe is sometimes used to overcome some of these bare pipe losses and related problems. Smaller diameter Thermocase 750 vacuum insulated tubulars may be used for this insulated steam injection pipe application. In a further modification, only the most critical portions of the steam injection piping may be insulated to reduce the high cost of these installations.

Besides high initial cost, other problems with existing insulated steam injection piping are known. Vacuum insulated tubulars require special couplings, are essentially double the weight of bare pipe (double wall vacuum construction), and each pipe section must be protected against loads that would result in a loss of vacuum. The double wall also obstructs flow, creating steam flow pressure loss and/or annulus flow limitations, or requires a larger diameter and therefore more costly wellbore. Other problems include reliability (e.g., loss of vacuum over time) and limited flexibility (e.g., inability to bend into some deviated holes and potential abrasion damage during installation). The special couplings are not as effectively insulated as the remaining portions of the string. In addition, special coupling complexity may result in unreliable sealing, allowing still further steam/heat loss.

None of the current approaches known to the inventor eliminates the problem of high steam injection costs. Either high initial and handling costs of insulated tubulars or the high operating costs of bare steam injection pipe must be accepted.

SUMMARY OF THE INVENTION

Many of these problems are avoided in the present invention by providing a bare steam injection pipe having a low emissivity outer surface combined with a gas injection system. The low emissivity surface is obtained by polishing. The outer pipe surface is solvent-washed after installation to maintain the low emissivity surface of the otherwise bare injection pipe. The installed injection pipe is combined with a non-condensable gas thermal barrier derived from a mixed fluid source. The mixed fluid is conducted downhole prior to the gas being separated. The gas is separated from the mixture and excludes steam from the casing/injection pipe annulus.

Like the currently used bare, but unpolished injection pipe which conducts only steam/water, the present invention is easy to handle and low in initial cost. However, the low emissivity surface and continuous gas introduction/separation achieves a significant reduction in heat loss. The present invention is also tolerant of corrosive fluids and off-design conditions. It is also reliable, cost effective, and makes efficient use of limited downhole radial space. The invention avoids double wall pipe flow blockage, added weight, increased cost, and piping inflexibility.

BRIEF DESCRIPTION OF THE DRAWINGS

FIG. 1 shows a schematic of a steam injection system apparatus;

FIG. 2 shows a perspective view of a steam injection pipe section; and

FIG. 3 shows an example of a test of the steam injection pipe section shown in FIG. 2.

In these Figures, it is to be understood that like reference numerals refer to like elements or features.

DESCRIPTION OF THE PREFERRED EMBODIMENT

FIG. 1 shows a schematic of a steam injection system apparatus. The steam injection system is supplied by a water source or reservoir of water 2. The water or other thermal transfer fluid from the reservoir 2 is flowed by gravity or pumped via a portion of surface water pipeline 3 to water softening tanks 4. The water softening tanks 4 are a series of ion exchange water treatment tanks. The ion exchange material within the water softening tanks 4 removes unwanted chemical constituents, such as calcium or other scale forming constituents. If suspended solids or other unwanted materials are also present in the water supply 2, filtration or other fluid cleaning means can be used in addition to, or in place of the water softening tanks 4. Another portion of the water pipeline 3 carries the softened water to a heat exchanger or water tube boiler 5 which generates steam or steam/water mixture.

The water, steam, or steam/water mixture is combined with output(s) of a first gas compressor 6*a* and/or a second gas compressor 6*b*. The gas compressors 6*a*/6*b* can supply pressurized non-condensable gases (or other barrier fluids) to be mixed with the water upstream (as shown by first compressor 6*a*) and/or mixture downstream of the boiler 5 (as shown by second gas compressor 6*b*). The compressed gas must not be condensable or deposit emissivity reducing materials on pipe surfaces at the wellbore conditions of temperature and pressure. The gas also must be less dense than at least the water portion of the steam/water mixture at these wellbore conditions, preferably less dense than the average steam/water mixture, and most preferably less dense than the steam portion of the steam/water mixture. Since the gas is intended to act as a thermal barrier fluid (i.e., an insulating material) to fill an annular space 7 within a casing 8, other desirable properties are low specific heat, low thermal conductivity, and low radiation absorptivity. Low cost and a generally chemically inert gas, such as nitrogen, are preferred. Other gases or gas mixtures available at site may be more preferable, such as less dense methane. The gas supply can be selected from many other non-condensable gases such as carbon dioxide and air or combinations of gases. In an alternative embodiment, the non-condensable gas is dissolved in the water source 2 and vaporizes at downhole conditions.

Fuel for the boiler 5 is supplied by fuel line 9. Fuel is mixed and combusted with air within the boiler 5. The water tube boiler 5 transfers the combustion energy to the softened water (and gas, if present), generating a steam and water (and non-condensable gas, if present) mixed phase fluid mixture. This heated mixture is supplied to a steam supply pipeline 10. The steam supply line 10 includes an expansion or flexible joint 11 to allow for thermal expansion of the casing 8 within an underground wellbore 12. The steam supply line 10 is also typically insulated to minimize thermal loss to the aboveground surroundings.

The surface piping of the steam supply line 10 is attached to a steam injection pipe 13 which is substantially contained within an underground wellbore 12 having a conventionally cemented casing 8. The wellbore 12 extends from the ground surface generally downward. The steam injection piping 13 is composed of a plurality of injection pipe sections 19 (see FIG. 2) which have been assembled end-to-end and run into the cased wellbore. The injection pipe 13 extends from near the ground surface to an open end near the underground interval zone or formation of interest (e.g., the formation to be heated).

The injection pipe sections are composed of material having and capable of retaining (i.e., affixing) a low emissivity surface, such as a polished stainless steel. The steam injection pipe sections are typically supplied in lengths of approximately 12 meters (40 feet), having nominal diameters ranging up to 13 inches, but more typically one to three inches in nominal diameter. Each pipe section includes interconnecting end fittings to form a portion of the injection pipe string. Other lengths, sizes and interconnections are also possible.

The steam injection line 13 is held near the center of the casing 8 by centralizers or stand-offs 14. The centralizers 14 are open spring steel devices which do not prevent communication of fluids within the annular space 7. The annular space or annulus 7 extends as a ring-like cylinder between the injection pipe sections. The steam injection piping is also centrally held in place near the surface by an end cap 15 and near the bottom by a packer 16. The end cap 15 restricts the flow of rising or pressurized non-condensable gas out of the annular space 7. The packer 16 is open to allow separated non-condensable gas to rise and fill the annular space 7.

The non-condensable gas supplied by first compressor 6*a* and/or second compressor 6*b* is introduced, heated and flows with the steam/water mixture to the bottom exit plane 17 of the steam injection pipeline 13. If a vacuum exists in the annular space 7, the fluid mixture will turn and fill the annular space. Heat losses at the casing 8 will condense a portion of the steam, again creating a vacuum. The water/condensate fluid portion will drain by gravity out of the annular space 7, leaving a higher concentration of non-condensable gas in the annular space. The condensation will draw additional fluid mixture resulting in increasing concentrations of non-condensable gas until the annular space 7 is filled with essentially all non-condensable gas.

In addition, the increased flow cross-sectional area at the opening or exit plane 17 slows the mixture, allowing partial separation of the non-condensable gas and the water/steam mixture prior to entry into the annular space 7. The less dense non-condensable gas tends to rise towards the packer 16. Since the packer 16 allows fluid communication with (i.e., restricts, but does not seal) the annulus, the non-condensable gas can continuously fill the annulus. Gas near the walls of the injection pipe (e.g., within a boundary layer) is the easiest to separate and fill the annulus 7, as shown by gas path arrow "A."

In an alternative boundary layer, the steam/water flow within the passageway can be characterized as annular (i.e., a liquid phase primarily flowing near the interior walls of the injection pipe and a gas phase primarily flowing near the center of the injection pipe passageway). The non-condensable gas is injected into the liquid water phase near the walls of the injection pipe passageway. The liquid and/or non-condensable gas at the injection pipe passageway walls tends to minimize thermal loss by excluding steam and the resulting condensation.

An alternative embodiment can fill the annulus 7 with a non-condensable gas through a valved annulus port 18 connected to the end cap 15. In this alternative embodiment, packer 16 may seal the annulus 7. If the non-condensable gas is air, the valved annulus port can be open to the atmosphere. In a modified embodiment, the packer 16 is not sealed and an initial amount of gas is supplied through port 18 while further (i.e., make up) gas quantities are supplied from the fluid mixture at opening 17 as described above.

The steam and hot water is directed into the formation of interest below the steam injection pipe exit 17, as shown by steam/water path arrows "B." A second packer (not shown for clarity) may also be provided below path arrows "B" to avoid steam/heat loss into other portions of the formation.

FIG. 2 shows a perspective view of a steam injection pipe section 19 which is assembled with other similar injection pipe sections to form the steam injection pipe 13 (see FIG. 1). A first end 20 forms the male half of an interconnective threaded joint, mating with an adjoining (not shown for clarity) second or female connector end 21. The female connector end 21 is radially enlarged to accept the first end of another adjoining pipe section (not shown for clarity). The steam injection pipe section is preferably composed of stainless steel, but alternatively can be composed of other materials of construction which can exhibit a low emissivity outwardly facing surface 23 (i.e., outer diameter).

The outer or exterior surface 23 (including the enlarged female connector end) is first polished and then mechanically cleaned after assembly and running into the well to obtain (and maintain) a low emissivity. Low emissivity is defined herein as a total emissivity of no more than 0.60, preferably no more than 0.50, most preferably no more than 0.40, and most highly preferred of no more than 0.30, at steam injection temperature conditions. A typical range of steam injection temperatures for thermal oil recovery is about 121° to 177° C. (250° to 350° F.).

Steel and stainless steel injection pipe materials in clean, unoxidized conditions can exhibit total radiation emissivities of less than 0.60, but are typically not supplied or maintained in that condition for thermal recovery applications. Conventional injection pipe field handling and wellbore conditions are expected to result in total emissivities approaching 1.0. Selection of materials having low emissivity surfaces or reducing the emissivity of materials having higher emissivity surfaces is required. For example, in the absence of emissivity increasing field handling or wellbore conditions, total emissivity of rolled, then oxidized, Type 310 stainless steel (e.g., during heat treatment) has been reported ("Thermal Radiation Properties Survey," by Gubareff, Janssen, and Torborg, 1960) as ranging from 0.56 to 0.81 at several different oxidizing temperatures. Field handling and/or wellbore conditions will only increase the emissivity of the outer surface of this piping material.

In accordance with the present invention, the total emissivity of the outermost and outwardly facing surface of a stainless steel pipe is reduced by polishing. The low emissivity is maintained during assembly by cleaning using mechanical wiping and formation compatible solvent contacting, if required. Cleaning may also be accomplished by brushing, jets of steam or contacting/flushing with other solvents. A particularly useful solvent which may be readily available is diesel oil.

The combination of the reduced/low emissivity outer injection pipe surface 23 and the filling of the annular space 7 (see FIG. 1) with a non-condensable gas obtained from the fluid mixture as described above significantly reduces radiation, convention and conduction heat transfer (i.e., thermal loss) to the casing 8 and wellbore 12 (see FIG. 1). The radiation heat transfer has been found to be as much as 90% of the heat losses to the casing/wellbore and reducing the emissivity achieves a directly proportional reduction in heat transfer. In contrast to vacuum insulated injection pipe where fluid is removed at an outer surface, only a barrier gas is required to achieve a reduction of approximately 50% in heat loss. Gas selection, injection, mixed phase flow character in the injection pipe, gas separation and containment in the annular space still further reduces heat transfer.

The spacing and geometry of the annular space combined with the thermal insulation properties of non-condensable gases has confirmed that convection is not a major factor. Testing of an insulating (i.e., low thermal conductivity) liquid filling the annular space 7 (see FIG. 1) resulted in increased heat losses, caused by increased convection. In addition, the lower the gas density, the easier it is to separate from the water/steam mixture.

In alternative embodiments, the reduced outer surface emissivity can be affixed by other devices and/or processes. These include plating (e.g., chrome plating), wrapping the outwardly facing surface with aluminum foil, painting the surface with a thin coat of aluminized or other low emissivity paint, cleaning a more emissive pipe material of construction (e.g., clean aluminum), chemically removing oxide layer or other materials from the surface, or combinations thereof.

The reduced/low emissivity surface injection pipe is combined with an insulating gas to exclude steam from within annulus 7 (see FIG. 1) during normal steam injection operations. However, steam or steam mixtures can be supplied to the annulus 7 through annular port 18 (see FIG. 1) to maintain (i.e., clean) the low emissivity surface. The injection pipe may also be cooled to condense the steam on the polished surface 23. The condensate (and dissolved contaminants) would flush downward to be removed or injected into the formation. The cleaning steam or steam mixtures may also be at reduced temperatures to minimize thermal stresses.

The gas is preferably selected to have desirable thermal and other properties as discussed above, but the gas may also be selected to maintain the low emissivity surface. Some contaminants, such as grease, evaporate into some non-condensable gas mixtures (i.e., evaporate to become a gas constituent until a partial pressure is reached). A continuous (i.e., make up) supply of gas from source **6*b* at the downhole location allows a small amount of the annular space gas to be bled at the top at annular port 18 (see FIG. 1**). This supplies uncontaminated gas and carries away evaporated contaminants. The small gas amount bled may be continuous or intermittent and does not significantly increase heat loss.

The invention is illustrated by the following example:

EXAMPLE 1

A test apparatus of the steam injection system previously described is shown in FIG. 3. A clean, saturated steam/water mixture (shown as "steam") having a temperature of approximately 175° C. (347° F.) prior to entry into the calorimeter 22. The water/steam mixture also contained a small amount of non-condensable gases, such as carbon dioxide. The cooling water (shown as "water") is used to absorb the heat traversing the annulus from the injection pipe section 19 to the simulated casing inside diameter (shown as "I.D."). The cooling water also maintained the I.D. (simulated inside diameter of cased wellbore) generally within a temperature range from 21° to 29° C. (70° to 85° F.). The calorimeter inside diameter (I.D.) was approximately 15.9 cm (6¼ inches). The injection pipe section 19 was centered within the calorimeter by end caps 15.

The flow and temperature of the cooling water entering and leaving the calorimeter was measured to determine the heat transferred. The outwardly facing surface 23 of the steam injection pipe section 19 was polished to a high luster finish to assure an acceptably low outer surface emissivity. In this example, the pipe section material was type 310 stainless steel having an as-received surface finish of approximately 30.0 AA. For control purposes, an unpolished and uncleaned steel pipe was substituted for the polished stainless steel injection pipe 19, and also tested.

Both of the injection pipe sections (polished stainless and control) had a length "C" of approximately 4.9 meters (16 feet). The cylindrical injection pipes were 2 inch nominal diameter pipe sections, having an outside diameter (outwardly facing surface) of 6 cm (2.38 inches). These injection pipe and calorimeter dimensions and conditions were expected to provide an acceptable simulation of down-hole conditions representative of typical thermal recovery installations.

Steam, condensate and non-condensable gas fluid mixture was injected into the bottom of the injection pipe ("steam"). A small gas flow ("inert gas") was bled at the top of the calorimeter. The steam condensing within the injection pipe section ran down the walls of the injection pipe, drawing the fluid mixture upward. Condensate was collected at the bottom and discharged through steam trap 24. Relatively large cooling flow rates and condensing steam conditions maintained relatively stable heat transfer conditions.

In contrast to conventional oil field conditions, the polished injection pipe section was maintained in a clean condition during and after assembly. Conventional field condition injection pipe outer surfaces typically has contaminants, such as lubricant or other coating(s), resulting in a total emissivity expected to be at least 0.9, normally approaching 1.0. This expectation was confirmed in testing of the control injection pipe section. A total emissivity of nearly 1.0 was calculated from calorimeter test results of the conventional (unpolished, unprocessed) steel pipe.

The outer surface of the type 310 stainless steel pipe section was polished to obtain a surface finish of 8.0 AA (i.e., the arithmetic average, peak to valley) as determined by a Proficorder instrument, manufactured by Bendix Corp, per ANSI (American National Standards Institute) procedures no. B46.1. This polished surface finish is compared with a surface finish of approximately 30.0 AA for the as-received and clean pipe surface, similarly measured. The polishing was accomplished by sanding using a belt sander. A 180 grit belt was used, followed by a 220 grit wheel, followed by a hard sisal wheel with a Triploy rouge. The surface was then wiped with a soft cloth wheel with Triploy rouge. The process achieved a high luster finish. This material and process at the steam temperature tested resulted in thermal data which show a calculated total emissivity of 0.3. Emissivity data for this and other materials indicates further reductions in total emissivity are possible.

Less extensive polishing can also significantly reduce the emissivity of the outwardly facing surface of the some injection pipe materials. Only careful handling (prevention of contamination), brushing or other cleaning planned as described below for maintaining the low emissivity surface may be all that is required for some materials to obtain a significantly reduced emissivity when compared to current practice. Any significant reduction in the outermost injection pipe surface emissivity will correspond to a significant reduction in radiation heat transfer and therefore reduce heat loss.

If the handling during this test process contaminated the polished surface, cleaning of the polished surface was planned to maintain the low emissivity of this surface. Cleaning was to have been accomplished by steam, solvent wash and/or mechanical wiping/rubbing during or after installation of the injection pipe. The mechanical rubbing/wiping was to be supplied with a solvent cleaning fluid to improve cleaning effectiveness, if required. In the testing, however, contamination was excluded, and cleaning was not required.

Further advantages of the invention include: safety (reduced thermal cycling of casing/casing), reliability (fewer components than vacuum insulated steam piping), ease of handling (field transport, inspection, assembly, installation and disassembly), low material and labor cost, and performance improvement when compared with uninsulated steam piping. The centralizers can more easily maintain the bare steam injection piping in the approximate center of the casing, which also minimizes the chance of damage, thermal contact and excessive heat transfer.

Still other alternative embodiments are possible. These include: cooling rather than heating the water or other thermal fluid; a combination of insulation and polished surface exterior steam injection piping having polished surface only at joints, providing added radiation barriers, such as plastic laminated aluminum foil; adding a polished surface protective layer, such as end caps, corrugated paper, covering layers and standoff materials; and providing a polished surface to the interior of the casing/casing.

The invention satisfies the need to reduce heat losses and casing temperatures without reducing the flow cross-sectional area of the well. Previous steam injection piping had been installed either without any insulation or with insulation requiring added thickness to the piping, thereby reducing cross sectional area.

While the preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. An apparatus for conducting a fluid mixture composed of a thermal fluid and a non-condensible barrier fluid, said apparatus comprising:

an outer duct;

an inner duct for conducting said fluid mixture, at least a portion of which is located within and spaced apart from said outer duct, said ducts forming an annular fluid passageway between portions of said inner duct and portions of said outer duct; and means for introducing said barrier fluid to said annular passageway from said fluid mixture within said inner duct.

2. The apparatus of claim 1 wherein at least a portion an outwardly facing outermost surface of said inner duct has a total emissivity of less than 0.6.

3. The apparatus of claim 2 wherein said barrier fluid introducing means also comprises means for at least partially separating said barrier fluid from said fluid mixture, wherein said separating means reduces the velocity of said fluid mixture within said annular passageway allowing gravity and fluid density differences to separate said barrier fluid.

4. The apparatus of claim 2 wherein said outwardly facing outermost surface has a surface finish of less than 30.0 AA when determined by ANSI B46.1 procedures.

5. An apparatus for conducting a fluid, said apparatus comprising:

a substantially thermally conductive outer duct;

a plurality of interconnected inner duct sections essentially forming a fluid conducting inner duct structure absent an intervening layer between a radially inward facing surface to a radially outwardly facing surface, at least a portion of which is located within and spaced apart from said outer duct, the proximate portions of said outer duct and inner duct sections forming an unsealed annular fluid passageway, wherein a portion of said outwardly facing surface of one of said inner duct sections has an emissivity less than said inwardly facing surface of said inner duct section; and means for introducing a barrier fluid to said annular fluid passageway, wherein said means for introducing is capable of filling a majority of said annular fluid passageway with said barrier fluid at a pressure of at least one atmosphere.

6. The apparatus of claim 5 wherein said annular passageway extends from a first end to a second end which also comprises:

means for removing a barrier fluid from said annular passageway located proximate to said second end wherein said barrier fluid is introduced into said apparatus proximate to said first end.

7. A pipe apparatus for conducting a thermal transfer fluid within a wellbore having a wellbore axis extending generally downward from a ground surface, said apparatus comprising:

a substantially thermally conductive outer piping string attached to said wellbore and having a piping centerline generally concentric with said wellbore axis, said outer piping string forming a fluid-containing surface;

a plurality of adjoining pipe sections located generally within said outer piping string and having a generally open end distal from said ground surface, at least a portion of one of said pipe sections exhibiting an outwardly facing reduced emissivity surface having an emissivity less than an inwardly facing pipe section surface and said portion essentially lacking an intervening layer between said inwardly facing and outwardly facing surfaces, wherein said adjoining pipe sections form a thermal fluid passageway from near said ground surface to said open end, and wherein said passageway and outer piping also forms an annular space in fluid communication with said thermal fluid near said open end; and means for introducing a barrier fluid to said annular space, wherein said means for introducing is capable of filling the majority of said annular space at a pressure of at least one atmosphere and sufficient to exclude said thermal fluid.

8. A pipe apparatus for conducting a thermal transfer fluid within a wellbore having a wellbore axis extending generally downward from a ground surface, said apparatus comprising:

an outer piping string attached to said wellbore and having a piping centerline generally concentric with said wellbore axis, said outer piping string forming a fluid-containing surface;

a plurality of adjoining pipe sections located generally within said outer piping string and having a generally open end distal from said ground surface, at least a portion of one of said pipe sections exhibiting an outwardly facing reduced emissivity surface having an emissivity less than an inwardly facing surface, wherein said adjoining pipe sections form a thermal fluid passageway from near said ground surface to said open end, and wherein said passageway and outer piping also forms an annular space within said fluid-containing surface;

means for introducing a barrier fluid to said annular space;

means for spacing apart said passageway and said outer piping string, wherein said spacing apart means does not prevent communication of said barrier fluid between locations proximate to one pipe section and proximate to an adjoining pipe section;

means for introducing said barrier fluid into said thermal fluid passageway;

means for continuously removing a portion of said barrier fluid from said annular passageway;

means for generating a fluid boundary layer within said passageway; and wherein said boundary layer generating means comprises means for injecting said barrier fluid at the periphery of said passageway.

9. The apparatus of claim 8 which also comprises a means for affixing said low emissivity surface to said one of said pipe sections wherein said means for affixing comprises a means for reducing the emissivity of an outwardly facing surface to a total emissivity of no more than 0.6 when said thermal fluid is conducted.

10. The apparatus of claim 9 wherein said means for reducing comprises a means for polishing said outwardly facing surface to a surface finish of less than 30.0 AA when determined by ANSI B46.1 procedures.

11. A process for conducting a thermal fluid within a conduit from near an aboveground location to an underground location when said conduit is inserted within a wellbore and a substantially thermally conductive casing wherein said conduit forms a structure essentially lacking an intervening layer from a radially inward facing surface to an outwardly facing outermost surface, said process comprising:

affixing a surface having an emissivity lower than said inwardly facing surface of said conduit to a portion of said outwardly facing outermost surface of said conduit;

inserting said low emissivity surface conduit into said wellbore to form a generally continuous ring-like space around at least a portion of said conduit; and introducing a barrier fluid to said ring-like space at a pressure of at least one atmosphere within said ring-like space.

12. The process of claim 11 wherein said affixing step comprises reducing the total emissivity of said outwardly facing surface to less than 0.6 and said introducing step also comprises:

mixing said barrier fluid and said thermal fluid to form a fluid mixture; and partially separating said barrier fluid prior to said introducing to said ring-like space.

13. The process of claim 12 which also comprises the step of maintaining the low emissivity properties of said outermost surface upon said inserting step.

14. A process for conducting a thermal fluid within a conduit essentially lacking an intervening layer from a radially inward facing surface to an outwardly facing outermost surface from near an aboveground location to an underground location when said conduit is inserted within a wellbore, said process comprising:

affixing a surface having an emissivity lower than said inwardly facing surface of said conduit to a portion of said outwardly facing outermost surface of said conduit;

inserting said low emissivity surface conduit into said wellbore to form a generally continuous ring-like space around at least a portion of said conduit;

introducing a barrier fluid to said ring-like space, wherein said barrier fluid exerts a pressure of at least one atmosphere within said ring-like space; and wherein said barrier fluid is a gas less dense than the average density of said thermal fluid.

15. The process of claim 14 wherein said gas is nitrogen.

16. The process of claim 15 wherein said thermal fluid is a mixture of steam and water at a temperature in excess of 112° C.

17. A process for conducting a thermal fluid within a conduit having a low emissivity outwardly facing surface when compared with an inwardly facing surface, said surface extending from near an aboveground location to an underground location when said conduit is inserted within a wellbore, said process comprising:

inserting said low emissivity surface conduit into said wellbore to form a generally continuous ring-like space around at least a portion of said conduit;

introducing a barrier fluid to said ring-like space which comprises the steps of:

mixing said barrier fluid with said thermal fluid within said conduit;

introducing said mixed fluids to said ring-like space; and removing a portion of said thermal fluid from said mixed fluids within said ring-like space.

* * * * *